US006373016B2

(12) United States Patent
Brouillat et al.

(10) Patent No.: US 6,373,016 B2
(45) Date of Patent: Apr. 16, 2002

(54) POLE FOR A LOW-VOLTAGE LIMITING ELECTRICAL POWER CIRCUIT BREAKER AND A CIRCUIT BREAKER EQUIPPED WITH SUCH A POLE

(75) Inventors: Alain Brouillat, La Valette; Lucas Pellegrin, Corenc; Marc Rival, Saint Ismier, all of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/825,059

(22) Filed: Apr. 4, 2001

(30) Foreign Application Priority Data

Apr. 10, 2000 (FR) ..... 0004545

(51) Int. Cl.[7] ..... H01H 3/00
(52) U.S. Cl. ..... 218/154; 218/157; 335/202
(58) Field of Search ..... 218/154–157, 218/15, 34–36, 40–41, 147–151; 335/201, 202

(56) References Cited

U.S. PATENT DOCUMENTS 4,521,653 A * 6/1985 Yoshiyasu et al. ..... 218/154
4,654,491 A * 3/1987 Maier et al. ..... 218/155
6,198,063 B1 * 3/2001 Kramer ..... 218/157
6,204,465 B1 * 3/2001 Gula et al. ..... 218/154

FOREIGN PATENT DOCUMENTS

| | | |
|---|---|---|
| DE | 728 612 C | 11/1942 |
| EP | 0 419 325 A | 3/1991 |
| EP | 0 887 832 A2 | 12/1998 |

* cited by examiner

*Primary Examiner*—Lincoln Donovan
*Assistant Examiner*—Tuyen Nguyen
(74) *Attorney, Agent, or Firm*—Parkhurst & Wendel, L.L.P.

(57) ABSTRACT

A pole of a low-voltage limiting electrical power circuit breaker comprises a stationary contact defining a contact area, at least one movable contact finger and an arc extinguishing chamber. The finger is pivotally mounted on a movable support, itself linked to an opening mechanism. A spring biases the finger to a contact position. The lateral branches of a U-shaped magnetic circuit bound the contacts on each side, with interposed insulating side walls which form a passage between the contact area and the arc extinguishing chamber. This passage forms a constriction at the inlet of the chamber. The pole comprises in addition a receiving surface of an electric arc root, situated between the contact area and the constriction and electrically connected to the contact area and which is extended towards the inside of the chamber by a narrower part.

10 Claims, 6 Drawing Sheets

POLE FOR A LOW-VOLTAGE LIMITING ELECTRICAL POWER CIRCUIT BREAKER AND A CIRCUIT BREAKER EQUIPPED WITH SUCH A POLE

BACKGROUND OF THE INVENTION

The invention relates to a low-voltage limiting electrical power circuit breaker.

The document U.S. Pat. No. 5,694,098 describes a limiting circuit breaker whose poles comprise a stationary contact and a movable contact situated at the inlet of an arc extinguishing chamber. The contacts are laterally bounded by the branches of a U-shaped magnetic circuit designed to produce a magnetic field tending to drive the movable contact in which a current is flowing to a separated position. An insulating shield is placed between the U-shaped magnetic circuit and the contacts, the side walls of the insulating shield forming a passage between the contact area and the inlet opening of the chamber.

For this type of apparatus, difficulties arise when short-circuit current breaking tests are performed with a relatively high voltage, for example at 100 kA with a voltage of about 600 Volts. This is due to the fact that, for high-rating limiting apparatuses of this type, it is difficult to obtain a high arc voltage, of about 600 to 700 Volts peak, in a small volume. The number of contact fingers and the width of the fingers are in fact conditioned by the rating of the apparatus, i.e. by the nominal value of the current intensity which is accepted by the apparatus. It then follows that when the rating of the apparatus is high, the side walls of the pole are at a fairly large distance from one another and do not enable an optimal heat exchange to be achieved with the electric arc. This deficit is then compensated by increasing the arc length, and therefore the distance between the stationary and movable contacts in the separated position, and by increasing the dimensions of the arc extinguishing chamber. The dimensions of the apparatus are therefore increased.

U.S. Pat. No. 2,555,993 describes a switch designed to interrupt the power supply of an inductance of a circuit breaker control circuit, this inductance having a direct current of about 200 A flowing through it. The switch comprises a stationary contact, a movable contact, an expansion chamber containing an inlet orifice and no outlet orifice, and a discharge stack situated between the contacts and the chamber inlet. The contacts are located in a passage whose width decreases from the contact area to the chamber inlet opening. The walls of this passage are made of an insulating material formed by phosphoreted asbestos in a 90% zircon substrate. The side walls of the passage are laterally bounded by two metal plates which form part of a U-shaped magnetic circuit excited by a winding so as to produce a magnetic field tending to displace the arc to the expansion chamber. When opening of the contacts takes place, the electric arc is propelled at high speed in the direction of the expansion chamber due to the magnetic field. When passing through the narrow part of the passage, the arc is subjected to constriction and cooling, due to the interaction with the walls of the passage. The ionized hot gases produced are outlet via the discharge stack and do not hinder the progression of the arc to the expansion chamber, so that the flames are confined in this chamber and are not discharged to the atmosphere. Expansion in the expansion chamber contributes to cooling the arc and to causing extinguishing thereof. Once the arc has been extinguished, the residual gases accumulated in the expansion chamber are outlet via the discharge stack. The object here is to increase the arc voltage until it exceeds the voltage at the terminals of the inductance in the course of discharge. The breaking performances of the apparatus are very low and dictated by the application, as the arcing current intensity never exceeds the initial value of 200 A, and the maximum dissipated energy corresponds to the energy stored in the inductance. Furthermore, the architecture of the apparatus is not transposable to a low-voltage limiting power circuit breaker, notably due to the hot exhaust gases discharged via the stack. Consequently, the teachings of this document do not appear to be transposable to low-voltage limiting power circuit breakers of the previously described type.

A power switch is described in the Patent DE 728,612. This switch comprises a stationary contact and a movable contact arranged in an arc extinguishing chamber formed by a volume containing the contacts, extended by a narrow slit which opens out, opposite the volume containing the contacts, on an open external space. The arc extinguishing chamber is bounded laterally by ceramic walls which are a relatively distant from one another at the level of the volume containing the contacts, move progressively towards one another to form a restriction at the entrance to the slit and are extended parallel to one another all along the slit. Two arcing horns extend from the volume containing the contacts to the opposite end of the slit, moving away from one another. Lateral blowing plates surround the ceramic side walls and constitute a magnetic arc blowout circuit. On opening of the contacts, the electric arc is blown magnetically into the slit. The divergent arrangement of the arcing horns is essential to compensate, or even over-compensate, the reduction of the cross-section for passage of the breaking gases to the outside. Movement of the arc inside the chamber is thus not hampered by a pressure increase. As it progresses into the slit, the arc finds new ceramic surfaces enabling a large heat exchange to take place. High-speed movement of the arc until the latter is extinguished avoids a too great local exposition in the chamber. The dimensions of this apparatus are very large. The length of the slit from the contacts to the opening onto the outside space must in fact be sufficiently great to enable the arc to be extinguished before it reaches the extremity of the chamber. In like manner, the distance between the arcing horns near to the opening to the outside is also very large, since it results from the continuous divergence between the arcing horns necessary to counteract the pressure increase due to the narrowing of the cross-section of the slit. In practice these constraints moreover impose an opening angle of about 120° between the arcing horns. Consequently, this technology would appear to be incompatible with the pursuit at the same time to achieve compactness and high breaking performances.

U.S. Pat. No. 2,970,197 describes a switch comprising a stationary contact means comprising a stationary main contact, a stationary secondary contact and a stationary arcing contact, operating in conjunction with a movable contact means bearing, on a single pivoting arm, a movable main contact, a movable secondary contact and a movable arcing contact. An arc extinguishing chamber equipped with separators is situated between the lateral branches of a U-shaped magnetic circuit. The contacts are situated in a passage which narrows progressively towards the chamber inlet. The magnetic circuit is supplied by a coil, serially connected between the stationary main contact and a lower arcing horn. Opening takes place in several stages: in a first step, the main contacts, situated at a relatively large distance from the arc extinguishing chamber, separate forcing the current to flow in the secondary contacts located closer to the chamber. In a second step, the secondary contacts also separate forcing the current to flow in the arcing contacts situated close to the chamber. A primary electric arc then arises between the arcing contacts when the latter separate. The arc lengthens and reaches the lower arcing horn dividing into two secondary arcs in series: a first secondary arc between the stationary contact and the lower arcing horn and a second secondary arc between the lower arcing horn and the movable arcing contact. As soon as the first secondary arc is drawn between the stationary arcing contact and the lower arcing horn, the magnetic circuit excitation coil is supplied. The impedance of the coil winding being lower than that of the first secondary arc, this arc is extinguished so that the whole of the current flows through the coil generating a magnetic flux between the lateral branches of the magnetic U. The magnetic field drives the second secondary arc to the chamber. In the chamber the arc encounters separators which cool the arc until it is extinguished. The progressive migration process of the arc to the chamber in this device is excessively long and incompatible with the performances expected from a limiting circuit breaker. The mechanism is also very complicated due to the presence of a multiplicity of contacts.

OBJECT OF THE INVENTION

The object of the invention is to increase the arc voltage of a high-rating limiting circuit breaker, in a small volume, by a simple device.

According to the invention, this object is achieved by means of a pole for a low-voltage limiting electrical power circuit breaker comprising an opening mechanism, the pole comprising:

a frame;

a first contact means comprising a contact area;

a second contact means comprising:

a movable support designed to be linked to the opening mechanism and movable with respect to the frame between a closed position and an open position, at least one contact finger movable parallel to a longitudinal mid-plane of the pole and able to take, with respect to the movable support in the closed position, a contact position in which the contact finger is in contact with the contact area of the first contact means, and a separated position in which the contact finger is separated from the first contact means, and a flexible return means designed to return the movable contact finger to its contact position, when the movable contact finger is close to its contact position;

an arc extinguishing chamber, comprising an outlet opening constituting the exhaust channel for outlet of all the gases emitted when breaking is performed, an inlet opening situated between the contact area and the outlet opening, arc energy absorption means situated inside the arc extinguishing chamber, and side walls laterally confining the arc extinguishing chamber, the distance measured perpendicularly to the longitudinal mid-plane between the side walls defining a width of the chamber;

a magnetic circuit, designed to be excited by a current flowing through the contact means, the magnetic circuit comprising two lateral branches which extend parallel to the longitudinal mid-plane on each side of the latter and which bound the contact area, the magnetic circuit being designed to produce a magnetic field tending to drive the contact finger through which a current is flowing to the separated position, an insulating shield comprising two insulating side walls interposed between the lateral branches and the contact means, the insulating side walls of the insulating shield forming a passage between the contact area and the inlet opening of the chamber, wherein:

the insulating side walls of the insulating shield are at a distance from one another which is smaller near the inlet opening of the arc extinguishing chamber than near the contact area, and which is smaller near the inlet opening of the arc extinguishing chamber than the width of the arc extinguishing chamber, so that the passage forms a constriction between the contact area and the movable contact means on the one hand and the arc extinguishing chamber on the other hand, this constriction being at least partially bounded laterally by the lateral branches of the magnetic circuit, the pole comprises in addition a first receiving surface of a root of an electric arc, situated between the contact area and the constriction and electrically connected to the first contact means.

The insulating side walls of the shield constitute a protection of the magnetic circuit against the electric arc. They moreover form a large heat exchange surface contributing to cooling of the arc. Constriction of the passage close to the chamber increases this heat exchange even further and enhances constriction of the arc. The two phenomena combined contribute to increasing the arc voltage and to high current limiting.

The magnetic circuit for its part performs a twofold function: on the one hand, a current limiting function performed in conjunction with the flexible return means, in so far as the magnetic field generates forces on the charges in movement in the movable contact through which a current is flowing, these forces tending to cause the contacts to separate independently of any opening order, above a threshold defined by the flexible return means; and on the other hand, a function of driving the arc to the arc extinguishing chamber through the obstacle formed by the constriction. This second function is partially performed by the part of the magnetic circuit near the contact area, but also more specifically by the part of the circuit bounding the constriction area. The larger this part situated laterally on each side of the constriction is, the more marked the effect achieved will be. By means of this device, a part of an electric arc of large cross-section such as is encountered when a high current is broken by a limiting circuit breaker is able to be made to enter the arc extinguishing chamber quickly, while at the same causing constriction of the arc and achieving a heat exchange with the insulating side walls when passing the constriction. The action of the magnetic circuit is extended until the arc is extinguished, so that a part of the arc remains in the chamber throughout the breaking operation, whereas the arc root remains at least partially on the first receiving surface. The arc therefore extends continuously on each side of the constriction keeping the arc voltage at a high level until the arc is extinguished. Contrary to the general teaching of the state of the technique which would incite the arc to be propelled as quickly as possible into the arc extinguishing chamber, the object of the present invention is to impose an intermediate position on the arc through a constriction until extinguishing of the arc is achieved.

With such a device, the distance between the stationary contact and the movable contact fingers in the separated position can be reduced, for a given performance level.

Preferably, the pole comprises a lower arcing horn electrically connected to the first contact means and comprising said first receiving surface of an electric arc root and an extension extending inside the arc extinguishing chamber, said extension constituting a second receiving surface for receiving an electric arc root the width whereof, measured along an axis perpendicular to the longitudinal plane of the pole, is smaller than that of the first receiving surface. The second receiving surface accommodates a part of the arc root for short-circuit currents of very high intensity. In addition, it enables the heat generated on the first receiving surface to be removed. Furthermore, the second receiving surface enables small currents to be broken, fostering in this case complete entry of the arc root into the arc extinguishing chamber. The width of the second receiving surface must however be smaller than the diameter of an arc root in short-circuit conditions, as in this case the arc has to be prevented from entering the chamber completely. In practice, the larger width of the second receiving surface has to be smaller than or equal to the distance between the walls of the insulating shield at the level of the constriction.

According to one embodiment, the pole comprises in addition an upper arcing horn having a free end situated near the movable contact means in the separated position and extending towards the inside of the chamber. The head of the electric arc migrates onto the upper arcing horn, with formation of a secondary arc in series with the first arc, between the upper arcing horn and the movable contact means. The head of the main arc migrates quickly to the inside of the chamber following the upper arcing horn, which enables the chamber to be made to play its energy absorption role.

Advantageously, the lateral branches of the magnetic circuit have an air-gap which is smaller at the level of the constriction than at the level of the contact area. Whereas the width of the air-gap of the magnetic circuit in its front part, where it bounds the contact fingers, is dictated by the width of the contact fingers and therefore by the circuit breaker rating, it is possible to take advantage of the front constriction of the inlet passage to the chamber to reduce the air-gap in the nearest part of the chamber, which enables the field to be increased in this region where arc displacement is hampered by the constriction.

According to one embodiment, the magnetic circuit forms a magnetic U, the base of the U being situated below the contact area of the stationary contact means. The U shape constitutes a good compromise between the quantity of metal necessary to constitute the magnetic circuit and the concentration of the field obtained. Other configurations can however be envisaged. The magnetic circuit can in particular form an O shape in cross-section, which enables an even greater concentration of the field to be achieved.

Preferably, the insulating shield comprises a gas-generating material resistant to the arc. Vaporization of the coating is a highly endothermal phenomenon which contributes to cooling of the arc. The pressure gradient generated by vaporization at the level of the constriction, which could prove to be an obstacle to displacement of the arc to the extinguishing chamber, is in fact compensated by suitable dimensioning of the magnetic circuit, in particular in its front part. Moreover, it is necessary for the material chosen to have a sufficient resistance to the arc to perform its function of lateral protection of the magnetic circuit. According to one embodiment, the insulating shield comprises a polyamide charged with glass fibers. In practice, the glass fiber charge should not exceed 30% to prevent the glass fibers from coming flush with the surface of the material after a few breaking operations. Alternatively or cumulatively, the insulating shield comprises a polyamide charged with mineral charges in proportions which may reach or exceed 30%. Alternatively it is possible to envisage using ceramics, but these materials have the drawback of fostering metal deposits originating from the contacts, which rapidly reduce their performances.

Preferably, the arc energy absorption means situated inside the arc extinguishing chamber comprise separators extending perpendicularly to the longitudinal mid-plane.

According to another feature of the invention, the latter also relates to a low-voltage limiting electrical power circuit breaker comprising an opening mechanism and at least one pole as previously described, whose movable support is linked to the opening mechanism.

BRIEF DESCRIPTION OF THE DRAWINGS

Other advantages and features of the invention will become more clearly apparent from the following description of different embodiments of the invention given as nonrestrictive examples only and represented in the accompanying drawings in which.

DESCRIPTION OF THE PREFERRED EMBODIMENTS

Figure 1:
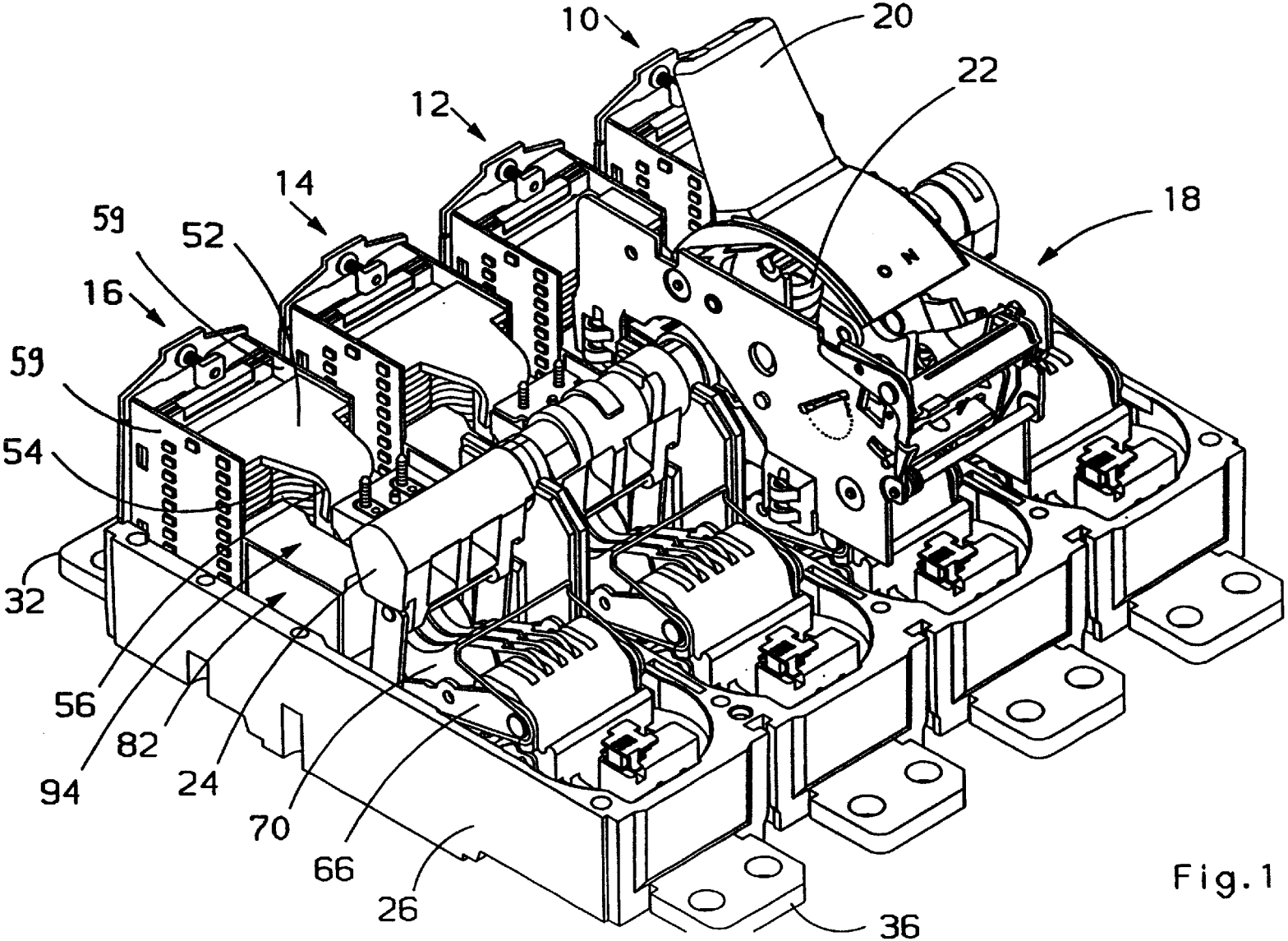
FIG. 1 represents a perspective view of a limiting circuit breaker according to a first embodiment of the invention.

With reference to FIGS. 1 to 5, a low-voltage limiting power circuit breaker comprises four poles 10, 12, 14, 16 and an opening and closing operating mechanism 18, fitted in an insulating case. The operating mechanism 18, of known structure, comprises an operating toggle 20, an opening and closing spring 22, and a pole shaft 24 pivoting on bearings arranged in intermediate walls of the case. The case comprises a frame 26 and a cover 28 which has been removed in FIG. 1 but can be seen in FIG. 2.

Each pole comprises a stationary contact means 30 connected to a first contact strip 32, a movable contact means 34 connected to a second contact strip 36 and an arc extinguishing chamber 38.

The stationary contact means 30 comprises a metal part 40 curved into a half-loop, which supports a contact pad 42 defining a contact area and which is extended towards the inside of the chamber by a metal lower arcing horn 44, at the potential of the stationary contact means 30. The horn 44 comprises a broad receiving surface 45 (FIG. 3) near the contact area and becomes narrower at the inlet of the chamber 38. It is extended inside the chamber by a tongue offering a receiving surface 47 (FIG. 3). The arcing horn 44 is secured to the stationary contact means on the one hand by two screws 46 (FIG. 3) near the contact pad 42, and on the other hand inside the chamber by a screw 48 whose head is insulated from the contact means by a sheath 50 made of plastic material. In addition to this lower arcing horn 44, the chamber comprises an upper arcing horn 52 and flat separators 54 arranged between the lower arcing horn 44 and the upper arcing horn 52, perpendicularly to the sectional plane II—II of FIG. 2, which constitutes a longitudinal mid-plane of the pole. The upper arcing horn 52 has a curved rear end 56 whose edge partially confines an inlet opening of the chamber 58. The chamber is confined laterally by side walls 59. The chamber is moreover provided with an outlet opening 60 equipped with a grate 62, the inlet opening 58 being situated between the contact area formed by the stationary contact pad 42 and the outlet opening 60.

The movable contact means 34 comprises a movable support 66 pivoting around a first fixed geometric axis 68 with respect to the frame 26, and three contact fingers 70 pivoting around a second fixed geometric axis 72 arranged parallel with and staggered with respect to the first axis. A connecting rod 74 couples the support 66 to the pole shaft. At one of their ends the fingers 70 support a contact pad 76 designed to perform the contact with the contact pad 42 supported by the stationary contact means 30. At their other end the fingers 70 form a cam 78 with two ramps on each side of a dead point. Between the support 66 and each finger 70 there is arranged an elastic energy storage means 80 comprising a spring 81 guided in a cage and pushing a rod supporting a rotary roller out of said cage. The roller is thus continuously in contact with the cam 78, so that the elastic energy storage means 80 constitutes a bistable mechanism with the cam 78.

The pole comprises in addition a U-shaped magnetic circuit 82 formed by a stack of transformer plates arranged perpendicularly to the longitudinal mid-plane II—II. The magnetic circuit 82 comprises a base 84 extending perpendicularly to the plane of FIG. 2 and two lateral branches 86 which extend appreciably parallel to the plane of FIG. 2. The curved part of the part 40 of the stationary contact means 30 surrounds the base 84 of the magnetic circuit 82 so as to induce therein a magnetic flux which is a function of the current flowing in the stationary contact means 30.

A rear part 90 of the magnetic circuit laterally confines the contact area formed by the stationary contact pad 42. Between the contact area 42 and the chamber 38, the magnetic circuit 82 comprises a front part 92 whose air-gap is narrower than that of the rear part 90.

A shield 94 comprising two insulating side walls 96 is interposed between the lateral branches 86 of the contact area 42. The insulating side walls 96 are formed by an insulating material resistant to the arc, preferably a gas-generating material, for instance a polyamide strongly charged with glass fiber (about 30%). At the rear, near the contact area 42, the insulating side walls 96 of the insulating shield 94 are parallel to the longitudinal mid-plane II—II of the pole, at a very small distance from the contact fingers. On the front side, between the contact area 42 and the inlet of the chamber 58, the insulating side walls 96 of the shield 94 are also parallel to the longitudinal mid-plane, but at a smaller distance from one another. The insulating side walls 96 of the shield 94 in addition comprise a flat intermediate part oblique with respect to the longitudinal mid-plane, forming the junction between the rear part and the front part. The width of the passage formed by the insulating side walls 96 of the shield 94 therefore decreases progressively by a third, or even a half, in the direction of the chamber 38, and constitutes a constriction 98 opening out into the chamber inlet. The shield 94 in addition comprises front and rear walls perpendicular to the longitudinal mid-plane and protecting the ends on the front and rear faces of the lateral branches of the magnetic circuit. The shield 94 also comprises an internal insulating and protective coating 97 in direct contact with the magnetic circuit, The coating 97 is formed by a liquid crystal polymer.

Operation of the device is as follows.

Figure 2:
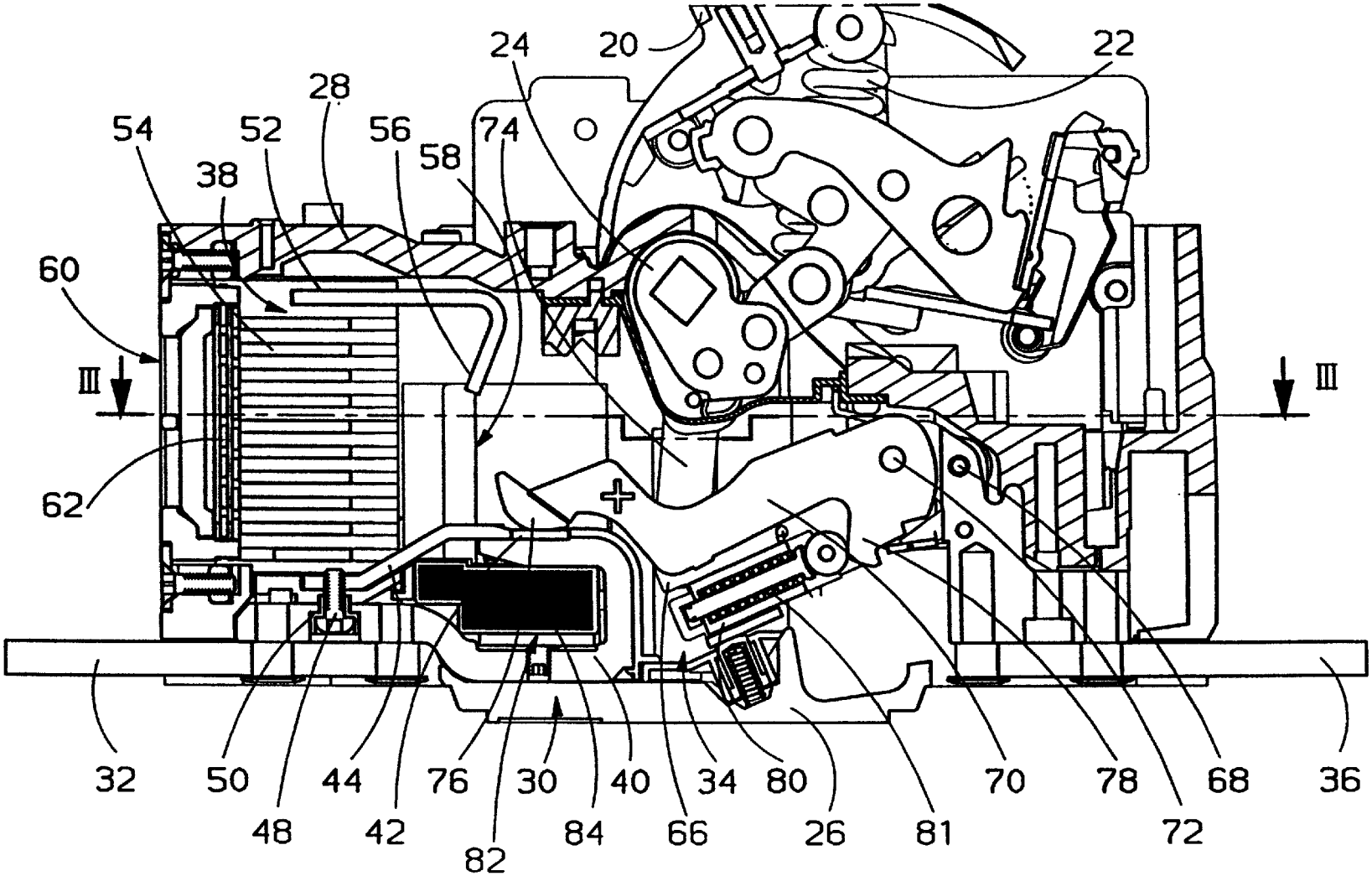
FIG. 2 represents a view of a pole of the circuit breaker of FIG. 1 in the closed position, in longitudinal cross-section along the plane II—II of FIG. 3.
Figure 3:
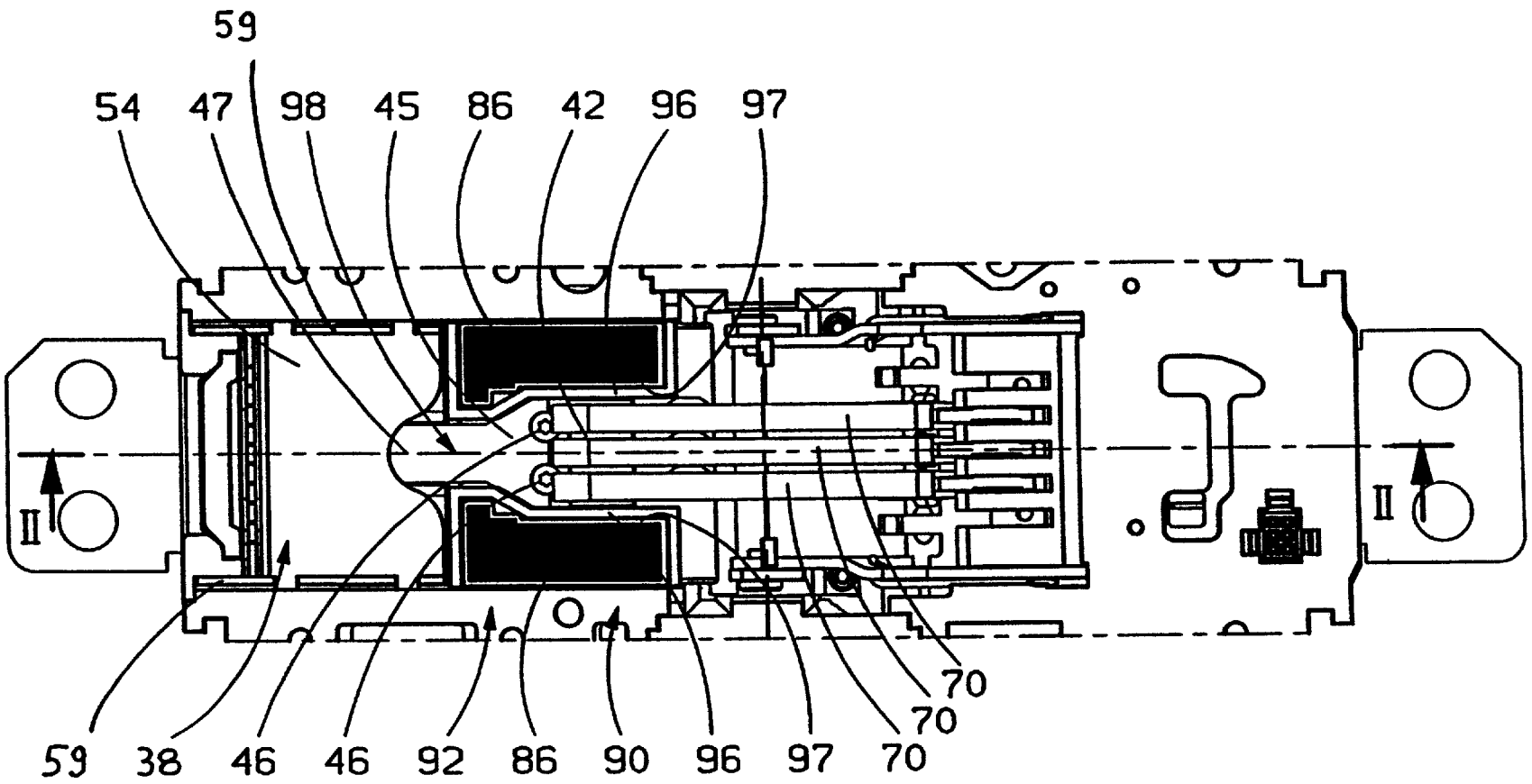
FIG. 3 represents a cross-sectional view along a plane III—III of FIG. 2.

In the closed position in FIG. 2, the circuit breaker allows the current to flow between the two contact pads 32, 36, through the contact means 30, 34 and the contact pads 42, 76. The bistable mechanism 80 biases the fingers 70 towards the stationary contact pad 42, providing a sufficient contact pressure.

In the event of a short-circuit, the current intensity is very high in the curved part 40 of the stationary contact means 30 and induces a large magnetic flux in the magnetic circuit 82. The magnetic circuit 82 concentrates the field lines between the lateral branches 86, in the contact area and in the area covered by the contact fingers 70 when opening takes place. The short-circuit current also flows through the contact fingers 70, the latter being subjected to repulsion forces induced by the magnetic field. These forces induced by the magnetic circuit are added to the striction forces at the interface between the pads 42, 76, so that the contact fingers 70 pivot against the return force of the spring 81 until the dead point of the bistable 80 mechanism is reached. Beyond the dead point, the combined action of the spring 81 and of the electromagnetic forces make the contact fingers 70 continue their travel clockwise to the separated position of FIG. 4.

An electric arc arises between the contact pads 42, 76 as soon as the latter separate, causing a sharp temperature rise in the passage. The walls 96 of the shield cause a gas emission in the rear part and in the narrowed front part of the passage, so that the pressure increases in the passage. The arc, subjected to the electromagnetic forces, curves towards the chamber 38 and the arc root migrates onto the broad part of the lower arcing horn 44 and tends to enter the chamber. However, the arc root has a large cross-section, which is a function of the short-circuit current intensity. The width of the arc receiving surface 47 situated on the part of the arcing horn extending inside the chamber 38 is insufficient to allow the arc root to migrate to the inside of the chamber 38. Consequently, the arc root occupies the whole available surface between the contact pad 42 and the front end of the lower arcing horn 44, inside the chamber. In other words, a part of the arc root remains on the broad receiving surface 44 of the lower arcing horn, before the constriction 98, whereas another part of the arc root is located on the narrower part 47 of the lower arcing horn, directly in the chamber, and remains there until the arc is extinguished.

Due to the large curvature of the arc caused by the magnetic field, an intermediate part of the arc, between its root and its head, enters the chamber as soon as separation of the contact pads 42, 76 takes place. This intermediate part of the arc passes through the constriction 98 where it undergoes both a large striction and large cooling, due to the interactions with the insulating side walls 96 of the shield 94. These two phenomena combine to contribute to increasing the arc voltage and to causing great limiting of the current flowing through the pole.

Figure 4:
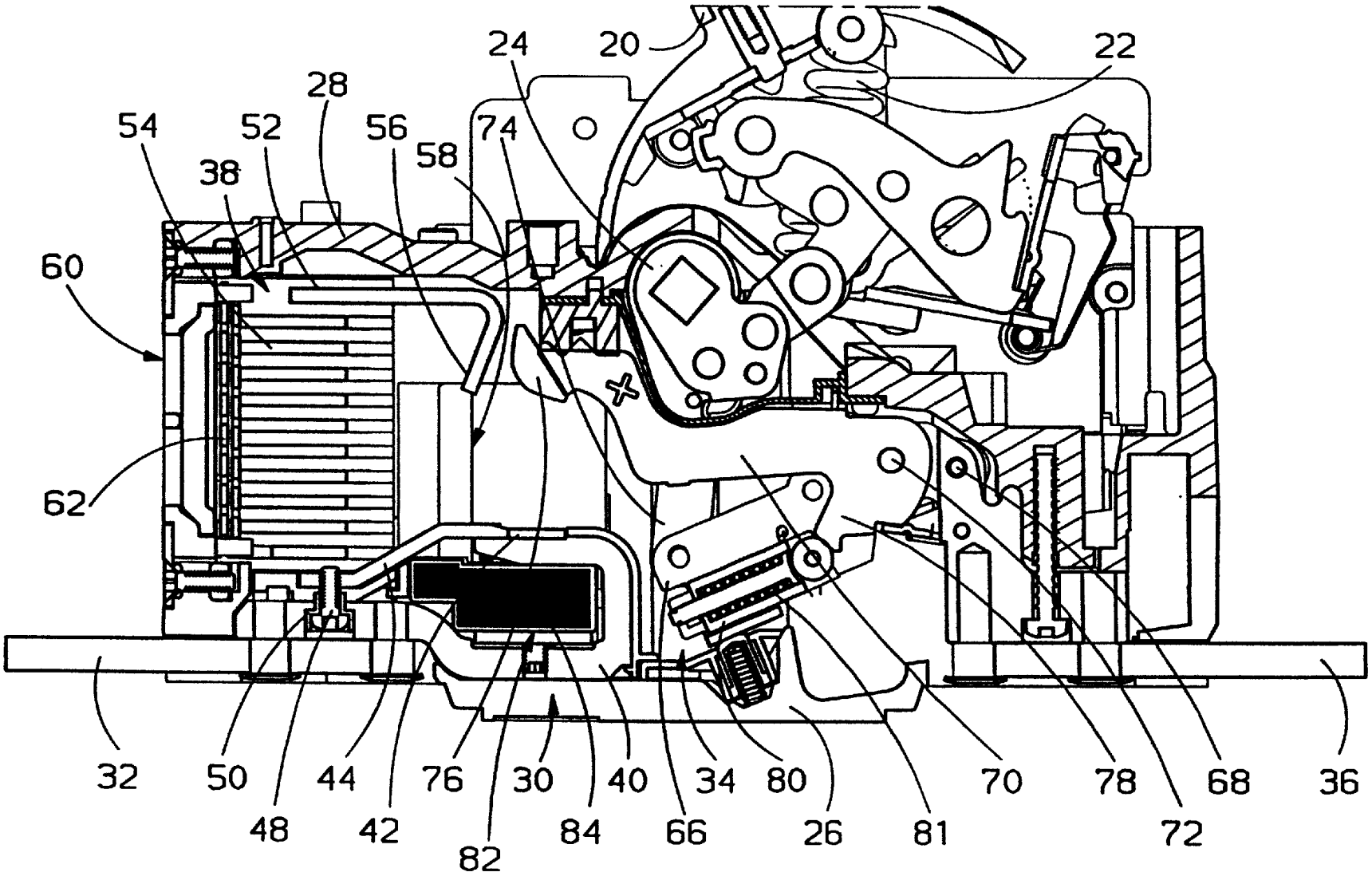
FIG. 4 represents a longitudinal cross-sectional view of the pole of FIG. 2, in the separated position.

When the contact fingers 70 reach the separated position of FIG. 4, the head of the main arc migrates onto the upper arcing horn 52, whereas a secondary arc forms in series with the first arc between the curved end 56 of the upper arcing horn and the contact fingers 70. As soon as this switching has taken place, the head of the arc can enter the chamber, which prevents a too great ablation of the walls of the case near to the curved end 56 of the upper arcing horn.

However, as previously indicated, the arc root remains at least partially on the broad part 45 of the arcing horn 44 situated between the contact pad 42 and the constriction 98.

Consequently, the striction and cooling effects of the arc caused by convergence of the walls 96 continue throughout the breaking operation, ensuring that a high arc voltage is maintained until the arc is extinguished.

It should be noted that in the absence of a magnetic field, the arc would tend to leave the chamber 38 and to move back towards the contact area 42 to minimize the dissipated energy and reduce the arc voltage. It is the field induced by the magnetic circuit 82, and in particular by the part of the circuit situated at the level of the constriction 98, which acts continuously on the arc until the latter is extinguished, and prevents the arc from moving back in the direction of the contact pads 42, 76. Reducing the air-gap at the level of the constriction 98 and the correlative increase of the magnetic field enhance this action even further.

Throughout opening of the contacts, the side walls 96 of the shield 94 are subjected to the arc, in particular at the level of the constriction 98. This is why the material constituting the shield 94 must be extremely rugged. The coating 97 performs insulation of the magnetic circuit in the event of failure of the shield, in particular should drops of molten metal happen to pass through one of the walls 96. Its function is to prevent in this case any risk of arcing between the magnetic circuit 82 and one of the contact means.

Figure 5:
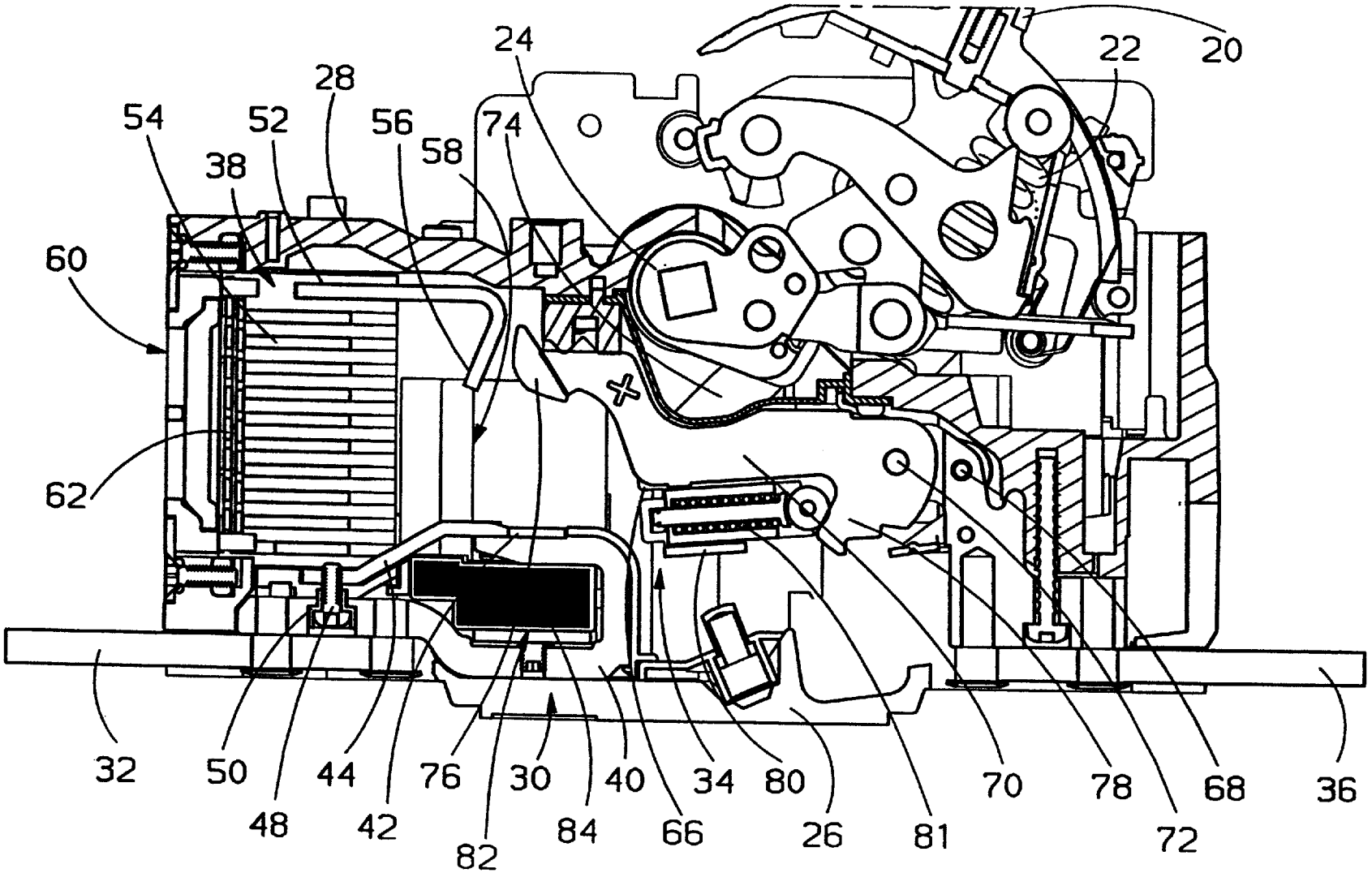
FIG. 5 represents a longitudinal cross-sectional view of the pole of FIG. 2, in the open position.

Opening is confirmed by an opening order of the mechanism 18, which drives the support to the position of FIG. 5.

When opening takes place on small currents, this opening is initiated by the mechanism 18. Switching then takes place directly from the position represented in FIG. 2 to the position represented in FIG. 5, without passing via the intermediate position of FIG. 4. The field induced by the magnetic circuit 82 is however sufficiently intense to project the arc towards the chamber. The cross-section of the arc root is small so that the arc root is able to pass through the constriction 98 and enter the chamber 38 completely, and then stabilize on the part 47 of the arcing horn located inside the chamber. Passing through the constriction 98 gives rise to cooling and constriction of the arc. Extinguishing of the arc takes place in conventional manner in the chamber 38.

Various modifications are naturally possible.

Figure 6:
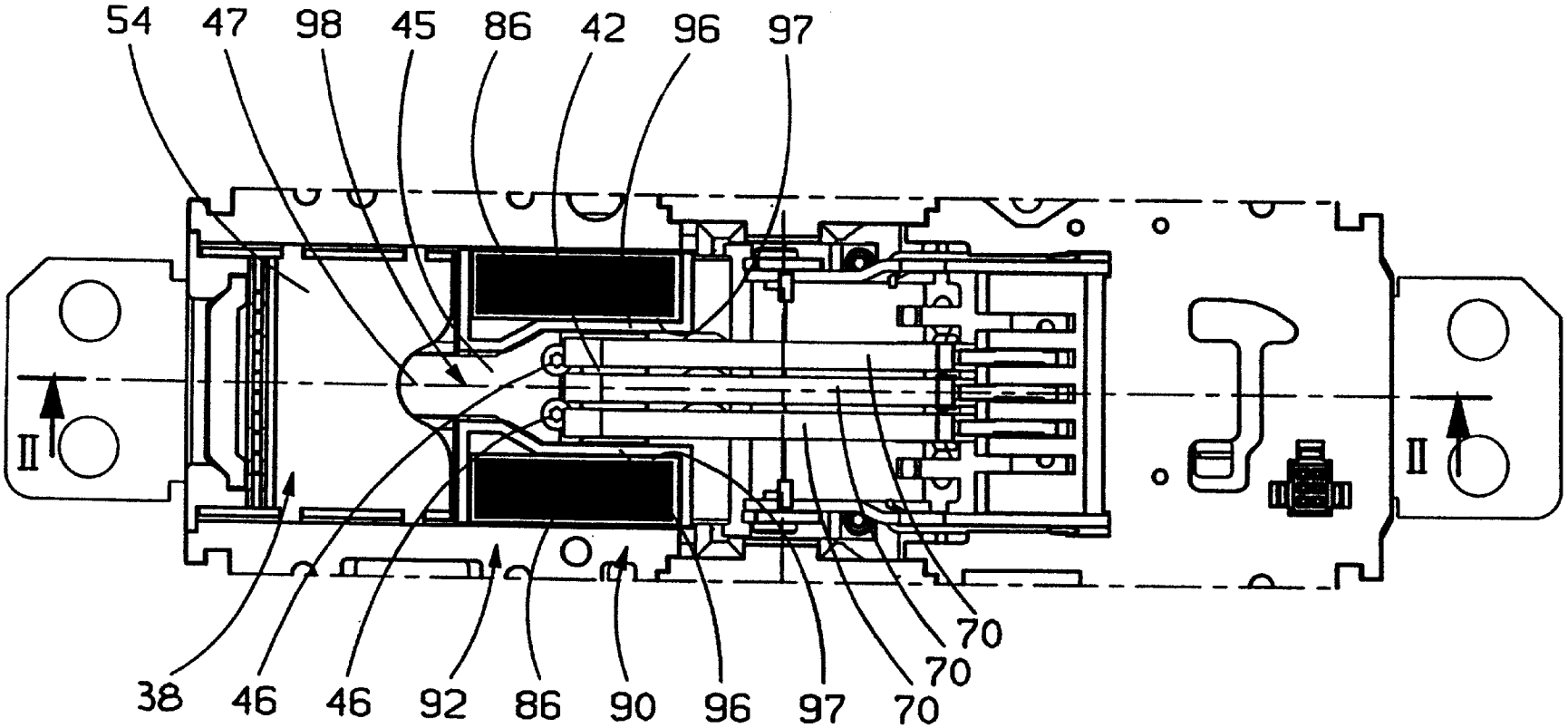
FIG. 6 represents a second embodiment of the invention, in a view corresponding to the view of FIG. 3 of the first embodiment.

According to a second embodiment represented in FIG. 6, the magnetic circuit 82 has a constant air-gap from its rear part to its front part. This embodiment is simpler than the previous one and may prove sufficient for less high breaking performances.

The structure of the limiting circuit breaker may be different from that of the example embodiment. In particular, it is possible to mount the contact finger or fingers pivoting around a spindle supported by the movable support. It is also possible to provide a conventional structure wherein the pole shaft and the supports are replaced by a single switching bar common to the poles. The invention also applies to a pole wherein the movable support of the movable contact means moves in translation.

The shield 94 can be charged with mineral particles designed to make it extremely strong without being detrimental to the dielectric qualities thereof. Good results have been obtained for example with zinc borate in proportions of up to 30% and more. The mineral particles can if required be added to the glass fibers or not.

Gas emission by the walls 96 increases the pressure in the passage. This pressure increase contributes to constriction of the arc and to increasing the arc voltage. However, the pressure increase is not necessarily homogeneous, and a pressure gradient may occur due to the constriction, which tends to oppose passage of the arc through the constriction. This is why it is not considered absolutely necessary to use a gas-generating material. In any event, a material must be chosen which does not give rise to a too great gas emission. The magnetic circuit must moreover be dimensioned so as to counteract the effects of the pressure gradient on the arc.

The coating 97 can be omitted if the strength and resistance in time of the shield 94 are sufficient to ensure the absence of arcing at the level of the magnetic circuit.

The length of the lower arcing horn inside the chamber is not necessarily large. From the standpoint of breaking of short-circuit currents in a high voltage, it is always preferable for a large part of the arc root to remain on the part 45 of the lower arcing horn situated between the contact pad and the constriction, as it is in this way that the arc is forced to pass through the constriction 98 throughout breaking. The extension of the arcing horn inside the chamber results from a compromise enabling in particular cooling of the arcing horn to be achieved during breaking.

The upper arcing horn can be omitted if the walls of the case are reinforced at this level, or if a gas-generating effect is required, for example to clean the contact pad 76.

The height of the constriction, i.e. its dimension along an axis perpendicular to the plane of FIG. 3, is not necessarily large. Experience shows that it is the bottom part of the constriction, closest to the lower arcing horn, which is essential.

What is claimed is:

1. A pole for a low-voltage limiting electrical power circuit breaker comprising an opening mechanism, the pole comprising:

a frame;

a first contact means comprising a contact area;

a second contact means comprising:

a movable support designed to be linked to the opening mechanism and movable with respect to the frame between a closed position and an open position, at least one contact finger movable parallel to a longitudinal mid-plane of the pole and able to take, with respect to the movable support in the closed position, a contact position in which the contact finger is in contact with the contact area of the first contact means, and a separated position in which the contact finger is separated from the first contact means, and a flexible return means designed to return the movable contact finger to its contact position, when the movable contact finger is close to its contact position;

an arc extinguishing chamber, comprising an outlet opening constituting the exhaust channel for outlet of all the gases emitted when breaking is performed, an inlet opening situated between the contact area and the outlet opening, arc energy absorption means situated inside the arc extinguishing chamber, and side walls laterally confining the arc extinguishing chamber, the distance measured perpendicularly to the longitudinal mid-plane between the side walls defining a width of the chamber;

a magnetic circuit, designed to be excited by a current flowing through the contact means, the magnetic circuit comprising two lateral branches which extend parallel to the longitudinal mid-plane on each side of the latter and which bound the contact area, the magnetic circuit being designed to produce a magnetic field tending to drive the contact finger through which a current is flowing to the separated position, an insulating shield comprising two insulating side walls interposed between the lateral branches and the contact means, the insulating side walls of the insulating shield forming a passage between the contact area and the inlet opening of the chamber, wherein the insulating side walls of the insulating shield are at a distance from one another which is smaller near the inlet opening of the arc extinguishing chamber than near the contact area, and which is smaller near the inlet opening of the arc extinguishing chamber than the width of the arc extinguishing chamber, so that the passage forms a constriction between the contact area and the movable contact means on the one hand and the arc extinguishing chamber on the other hand, this constriction being at least partially bounded laterally by the lateral branches of the magnetic circuit, the pole comprises in addition a first receiving surface of a root of an electric arc, situated between the contact area and the constriction and electrically connected to the first contact means.

2. The circuit breaker pole according to claim 1, comprising a lower arcing horn electrically connected to the first contact means and comprising said first receiving surface of an electric arc root and an extension extending inside the arc extinguishing chamber, said extension constituting a second receiving surface for receiving an electric arc root the width whereof, measured along an axis perpendicular to the longitudinal plane of the pole, is smaller than that of the first receiving surface.

3. The circuit breaker pole according to claim 1, comprising in addition an upper arcing horn having a free end situated near the movable contact means in the separated position and extending towards the inside of the chamber.

4. The circuit breaker pole according to claim 1, wherein the lateral branches of the magnetic circuit have an air-gap which is smaller at the level of the constriction than at the level of the contact area.

5. The circuit breaker pole according to claim 1, wherein the magnetic circuit forms a magnetic U having a base situated below the contact area of the stationary contact means.

6. The circuit breaker pole according to claim 1, wherein the insulating shield comprises a gas-generating material resistant to the arc.

7. The circuit breaker pole according to claim 6, wherein the insulating shield comprises a polyamide charged with glass fibers.

8. The circuit breaker pole according to claim 6, wherein the insulating shield comprises a polyamide charged with mineral charges.

9. The circuit breaker pole according to claim 1, wherein the arc energy absorption means situated inside the arc extinguishing chamber comprise separators extending perpendicularly to the longitudinal mid-plane.

10. A low-voltage limiting electrical power circuit breaker, comprising an opening mechanism and at least one pole according to claim 1, whose movable support is linked to the opening mechanism.

* * * * *